US005775608A

United States Patent [19]

Dumaine et al.

[11] Patent Number: 5,775,608

[45] Date of Patent: Jul. 7, 1998

[54] REVERSIBLE GRANULATOR

[76] Inventors: Thomas J. Dumaine, 432 Kelly Blvd., North Attleboro, Mass. 02760; Mark A. Weldon, 42 Malbone St., Lakeville, Mass. 02347

[21] Appl. No.: 835,237

[22] Filed: Apr. 7, 1997

[51] Int. Cl.[6] ..... B02C 18/06; B02C 18/18

[52] U.S. Cl. ..... 241/242; 241/294

[58] Field of Search ..... 241/189.2, 242, 241/294, 300, 292.1

[56] References Cited

U.S. PATENT DOCUMENTS

| | | | |
|---|---|---|---|
| 1,374,207 | 4/1921 | Jacobson . | |
| 1,876,416 | 9/1932 | Hill . | |
| 2,482,279 | 9/1949 | Lemmon et al. . | |
| 2,514,111 | 7/1950 | Wilson . | |
| 2,639,096 | 5/1953 | Hinerfeld . | |
| 3,561,685 | 2/1971 | Feder . | |
| 3,637,145 | 1/1972 | Williams . | |
| 3,806,048 | 4/1974 | Williams . | |
| 4,000,860 | 1/1977 | Gotham . | |
| 4,028,779 | 6/1977 | Shah | 241/73 |
| 4,239,160 | 12/1980 | Hawkins et al. | 241/222 |
| 4,545,538 | 10/1985 | Prew . | |
| 4,545,539 | 10/1985 | Steffensen . | |
| 4,651,934 | 3/1987 | Bender et al. . | |
| 4,706,899 | 11/1987 | Parker et al. . | |
| 4,830,291 | 5/1989 | Williams . | |
| 5,002,233 | 3/1991 | Williams . | |
| 5,060,875 | 10/1991 | McBride . | |
| 5,062,575 | 11/1991 | Barnabie et al. . | |
| 5,125,585 | 6/1992 | Williams . | |
| 5,161,746 | 11/1992 | Bliss . | |
| 5,195,685 | 3/1993 | Dumaine | 241/242 |
| 5,273,218 | 12/1993 | Burns | 241/32 |
| 5,547,136 | 8/1996 | Steffans et al. . | |

*Primary Examiner*—John M. Husar
*Attorney, Agent, or Firm*—John R. Benefiel

[57] ABSTRACT

A reversible granulator includes double-edged cutting blades mounted on a rotor with each of the edges on an opposite side of the cutting blade. A pair of fixed bed knife members each have a pair of peak cutting edges with an intervening clearance space. One peak cutting edge in each bed knife cooperates with one blade cutting edge when the rotor is rotated in one direction to cut material, while the other peak cutting edge cooperates with the other blade cutting edge upon rotor rotation in the opposite direction.

11 Claims, 3 Drawing Sheets

REVERSIBLE GRANULATOR

BACKGROUND OF THE INVENTION

This invention concerns granulators used to cut up plastic scrap into small pieces, readying the plastic scrap for recycling. Other scrap materials are also granulated. Granulators typically consist of a rotor having several cutting blades mounted on its outer perimeter, the cutting edge of each blade extending parallel to the rotor axis and axially along a portion of the length of the rotor. A series of several blades can each extend the full length of the rotor, or the blades can be segmented, each segment occupying a portion of the total rotor length. The segments may also be circumferentially staggered about the rotor axis or be in alternate circumferentially offset locations.

Each blade cuts against one or more stationary bed knives, each having an edge surface cooperating with the rotor blade cutting edge as the rotor rotates the blade past the bed knife to carry out cutting of the plastic. The bed knives are located to provide a proper clearance with each cutting edge. A sizing screen formed with a pattern of through holes is located beneath the rotor and receives the cut up plastic fragments and allows them to pass out of the granulator when cut small enough to pass through the perforation. Larger cut pieces are recirculated and cut repeatedly as necessary until small enough to pass through the screen holes.

The degree of cutting and particle size may be controlled by selection of the size of the screen holes.

The rotor blade and bed knife cutting edges periodically need resharpening, requiring that the blades be removed from the rotor and chamber, and then reinstalled and the cutting clearance with the bed knife carefully reset. The machine is of course not able to be run during this process, and it would thus be advantageous to minimize the need for this maintenance chore.

Jam conditions can sometimes arise when a mass of material becomes wedged in the cutting chamber such as to prevent rotor rotation. Limited reverse rotation to clear jams has heretofore been provided in cutting machines of other types, but not in granulators.

For example, reversible hammer mills have been heretofore provided to clear jams and reduce wear on the hammer surfaces.

However, reversible granulator machines have not heretofore been provided.

The use of electric motors which are run in a single direction complicates installation of the machine, since the correct phase of the electrical power supply must be consistent with the direction of motor rotation. This is particularly burdensome where the granulator is regularly moved to different locations, as to be near different machines generating plastic scrap, and the power supply phasing must be checked at each location.

It is the object of the present invention to provide a reversible granulator capable of cutting in either direction of rotor rotation so as to reduce the frequency of blade sharpenings in order to reduce downtime and maintenance labor, as well as to enable very effective clearing of jam conditions. Additionally, with this reversing feature, the phase of the power supply for the granulator does not need to be matched to the requirements of the drive motor.

SUMMARY OF THE INVENTION

The above recited object of the invention is achieved by incorporating double-edged cutting blades mounted to the rotor configured so that both of the cutting edges lie on a cutting circle extending around the rotor axis. The blade cutting edges are formed on opposite sides of the cutting blade and are directed in opposite directions.

A pair of adjustable fixed bed knife members are also provided, each bed knife having a pair of cutting edges on each side. Each pair of cutting edges are separated by a clearance space formed by an arcuate or vee groove. Preferably the bed knife cutting surface pairs comprise a rounded groove machined into a single member.

Each fixed bed knife member is adjustably mounted to enable the clearance space with each rotor blade cutting edge to be set. The adjustable bed knife mounting may advantageously comprise a recess in an adjacent wall defining the cutting chamber, which receives the bed knife member. A clamping bar having a series of threaded holes formed therein is positioned below the bed knife member. Bolts passing through respective enlarged holes in the bed knife member are received in respective threaded vertical holes in the clamping bar.

When the bolts are tightened, the bed knife member is drawn up against the top surface of the recess to clamp the bed knife member in any adjusted position.

In and out adjustments of the bed knife cutting edges are carried out by engagement screws in horizontal threaded holes in the side wall engaging the back edge of the bed knife member.

The rotor is driven by a reversible motor so that one cutting edge on each rotor blade cuts against a respective bed knife edge in each pair to primarily carry out the cutting action using one set of cutting edges in each direction of rotation of the rotor.

DETAILED DESCRIPTION

Figure 1:
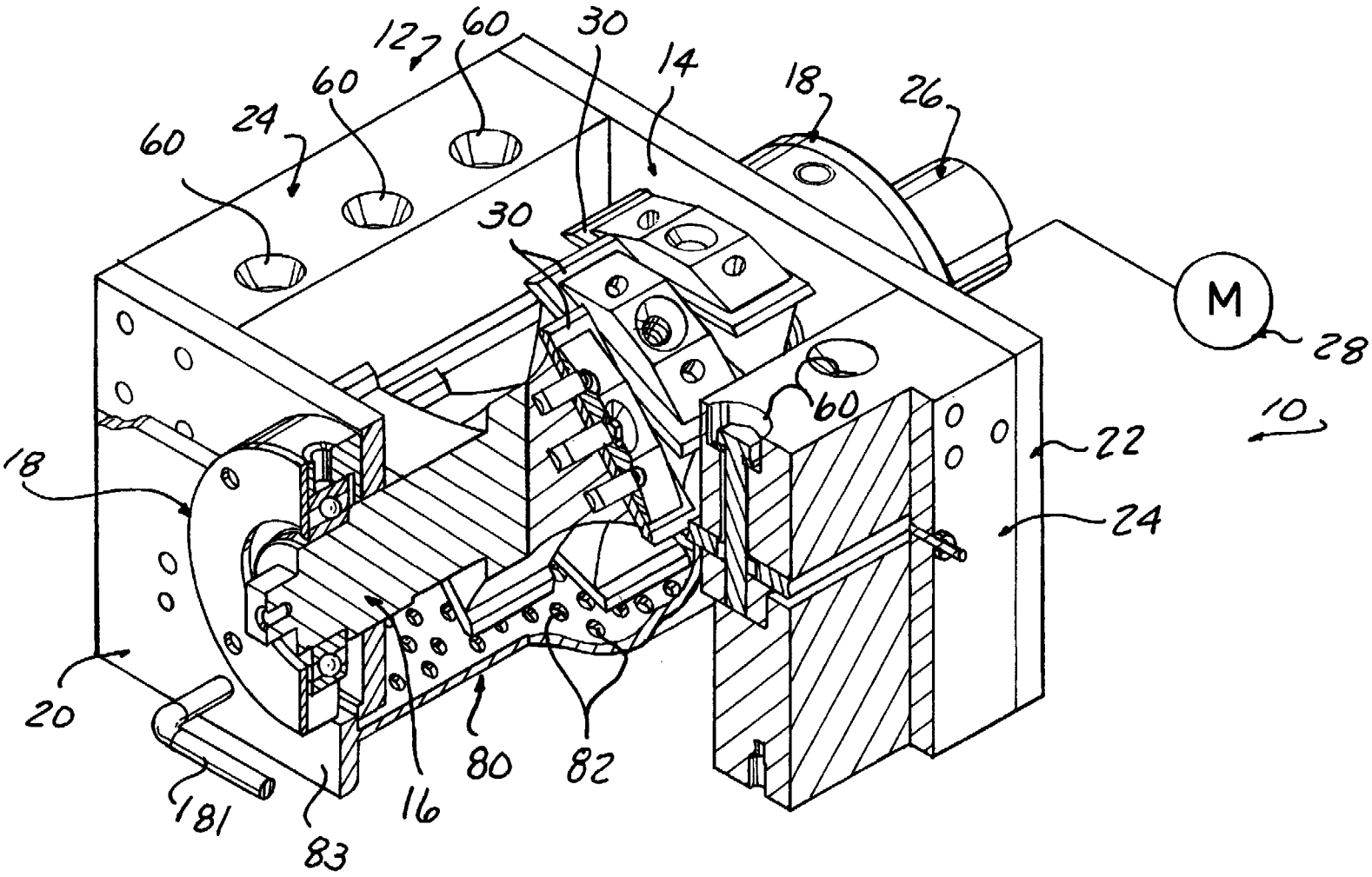
FIG. 1 is a partially broken away perspective view of a granulator according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the granulator 10 according to the present invention includes a housing 12 defining a cutting chamber 14. The surfaces defining the chamber interior are machined to be smooth for good granulate flow and easy cleaning. An alloy steel rotor 16 is mounted in the cutting chamber 14 for rotation about its longitudinal axis. Bearing assemblies 18 on either end of the rotor 16 are supported externally on front and rear wall plates 20, 22 of the housing 12 to avoid contamination. A feed hopper H is mounted atop the housing 12, and the housing 12 in turn is mounted on a base B having a discharge outlet and transport equipment.

A pair of knife blocks 24 are secured to the inside of the front and rear wall plates 20, 22. A protruding rotor drive shaft 26 is adapted to be driven by a reversible electric motor 28 by a suitable drive mechanism such as a belt, chain, or gear system (not shown).

In the design shown, the rotor 16 has four sets of mounting surfaces 32, each set disposed on opposite sides of the rotor axis. Each set of surfaces 32 is also staggered circumferentially from the others and occupying a portion of the length of the rotor 16.

Figure 2:
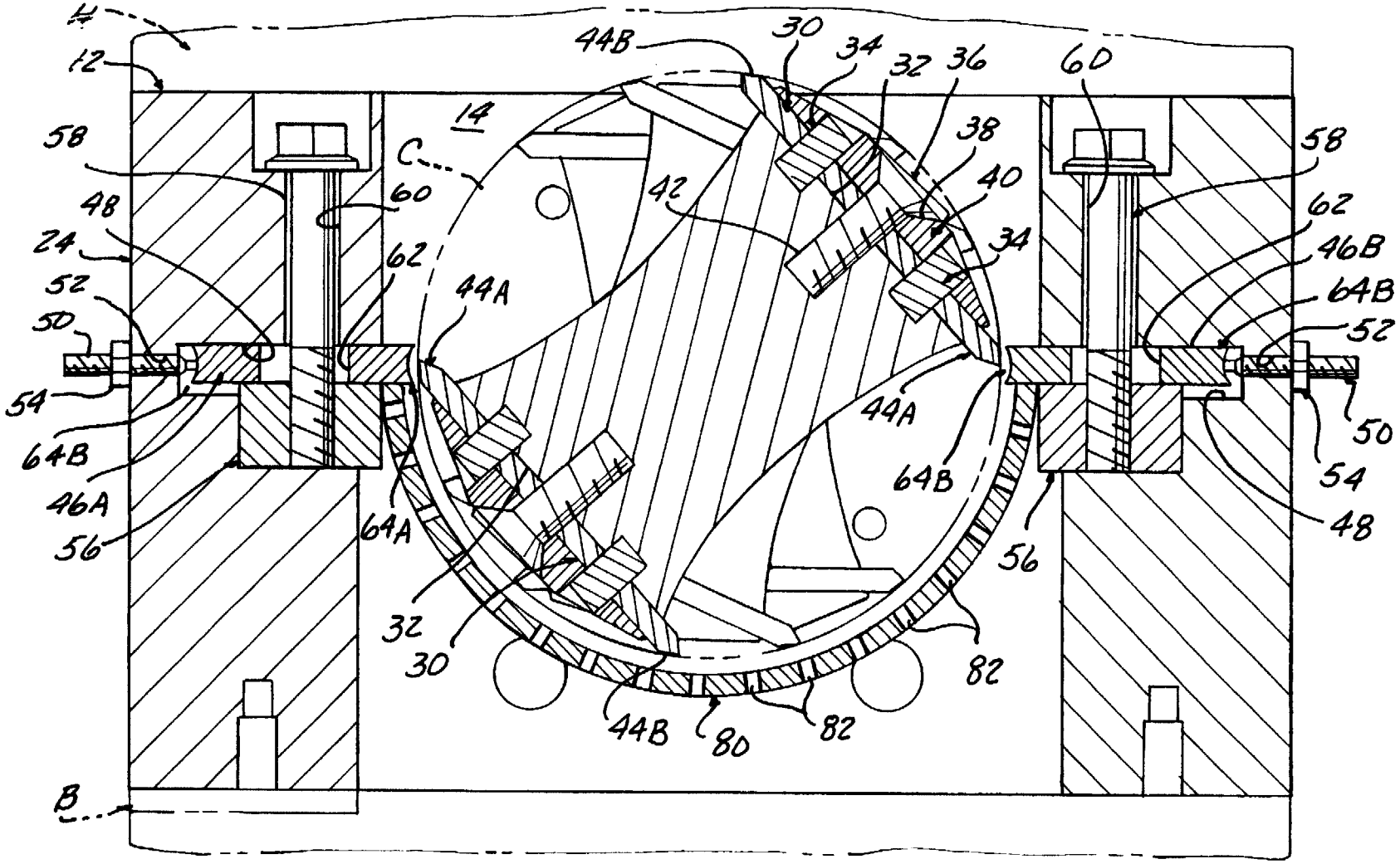
FIG. 2 is a view of a transverse section taken through the granulator shown in FIG. 1.

A double-edged cutting blade 30 is mounted against each surface 32, as seen in FIG. 2, each blade pair on a respective set of surfaces 32 thereby staggered circumferentially from the other pairs.

A trough-shaped screen 80 is positioned within the cutting chamber 14, screen 80 formed with a pattern of holes 82 of a predetermined diameter and spacing selected to set the particle size. A hole diameter range of 3/32 inch to 1-¼ inches and a spacing range from 0.071 to 0.941 inch are adequate for most applications. The total open area affects the throughput of the granulated plastic pieces in the well known manner.

The cutting blades 30 are accurately located by dowel pins 34 and secured with a machine screw 36 having a head seated on a counterbore 38 in a shield 40 positioned atop each cutting blade 30, screw 36 threaded into a threaded hole 42 extending perpendicularly into surface 32. The screen 80 can be slid out of the chamber 14 for cleaning by grasping the handle 81 welded to an end plate 83 of the screen.

The cutting blades 30 are of a high chrome alloy steel such as D2 tool steel, heat treated for long life. Various cutting blade materials and heat treatments can be used for cutting scrap other than the common plastics, as will be understood by those skilled in the art. Each cutting blade 30 has a pair of cutting edges 44A, 44B extending along opposite sides parallel to the axis of the rotor 16, each cutting edge 44A, 44B facing in an opposite circumferential direction, with the peak lying on a common imaginary cutting circle C concentric to the rotor axis. The cutting blades 30 extend at a transverse angle to the perimeter of the cutting circle C, as shown.

An upstroke and downstroke bed knife 46A and 46B are mounted on opposite sides of the cutting chamber 14, disposed in respective slotted recesses 48 machined into inner surface of a respective knife block 24. The bed knives are also of alloy steel such as D2 PSP 5.3.1.

The bed knives 46A and 46B are each adapted to be adjustably positioned in the recesses 48 with respect to the cutting edges 44A, 44B by means of elongated Allen screws 50, each Allen screw threaded into a threaded hole 52 in the knife blocks 24, the Allen screw 50 engaging the backside 64B of a respective bed knife 46A, 46B at spaced points along the length thereof. The Allen screws 50 are secured in any adjusted positions by locking nuts 54.

A clamping bar 56 is disposed in a pocket located below each of the recesses 48, receiving a series of clamping bolts 58 extending through vertical counterbore holes 60 and oversized slots 62 in the bed knives 46A, 46B. The bed knives 46A, 46B are adjusted to provide proper clearance with the peaks of the knife blade edges 44A, 44B. The peaks should be close to being in alignment with each other and a clearance of 0.005–0.008 inch with the bed knives 46A, 46B is normally set with respect to the highest rotor knife tip.

The fixed bed knives 46A, 46B each have shallow vee or arcuate shaped, double-edged cutting shapes 64A, 64B. The arcuate shape enables easier machining and sharpening as a rounded tool can be used to form and sharpen the cutting edges.

Cutting shapes 64A, 64B of the bed knives 46A, 46B each include peak edges 68A, 68B, and 70A, 70B closest to the cutting circle C with intervening clearance spaces allowing the blade edges 44A, 44B to be rotated past the peak edges 68A, 68B, and 70A, 70B.

Figure 3A:
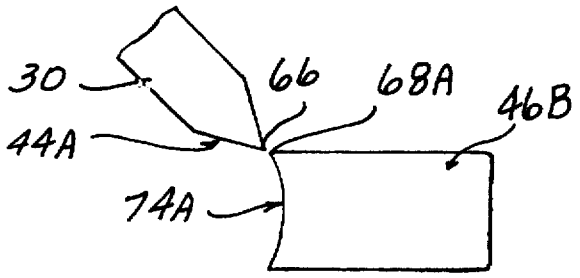
FIGS. 3A, 3B, 4A, and 4B are fragmentary enlarged end views of the cooperating cutting edges of the rotor and bed knives shown with rotation in respective opposite directions.

FIG. 3A shows the peak 66 of the right hand cutting edge 44A of rotor cutting blade 30, which is leading with clockwise rotation of the rotor 16, moving down until projecting directly towards the downstroke peak edge 68A of the right bed knife 46B.

Figure 3B:
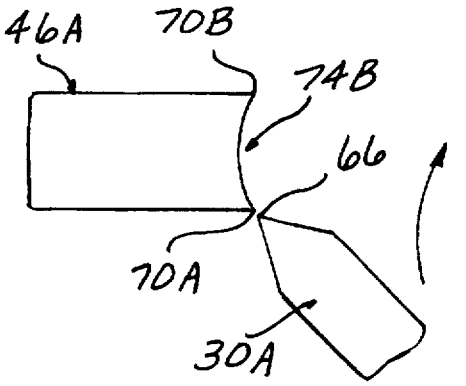

Peak 66 is shown moving up to the upstroke peak edge 70A of the left bed knife 46A in FIG. 3B, which project directly towards each other when moving into alignment.

Figure 4A:
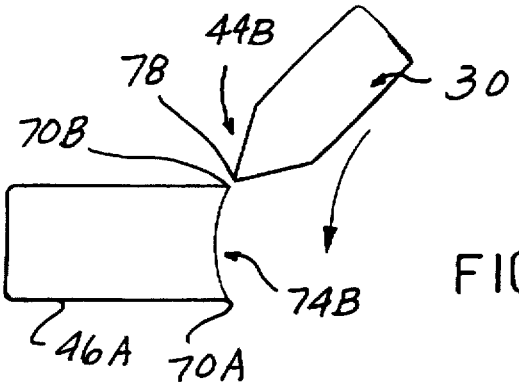
Figure 4B:
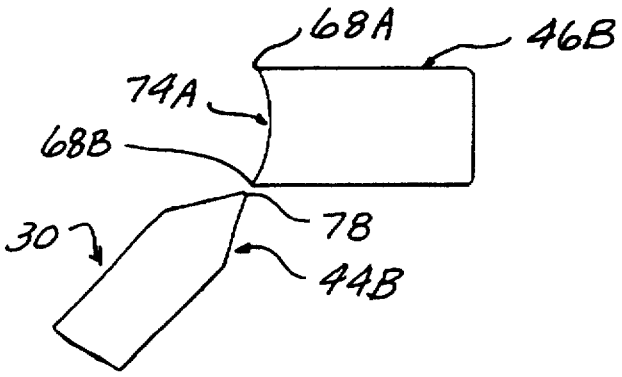

FIGS. 4A, 4B show the peak 78 of the opposite side blade cutting edge 44B passing peak edges 68B, 70B upon rotor rotation in the clockwise direction, which motion primarily cuts the material when the rotor is rotating in the counterclockwise direction.

The vee shape of the cutting blade edges 44A, 44B and bed knife sides 74A, 74B produces a clearance just beyond the minimum clearance edges in either direction of cutting.

Accordingly, effective cutting action takes place upon rotation of the rotor 16 in either direction with each bed knife acting as an upstroke bed knife in one direction of rotor rotation and as a downstroke bed knife when the rotor rotation is reversed.

Jam conditions can be efficiently cleared by continued reverse rotation.

The cutting edges will have substantially lengthened service life before resharpening will be necessary when the rotor 16 is rotated in reverse directions for one half of each service interval.

Installation is simplified, as the phase of the electrical power supply circuit need not be matched to the motor rotation direction.

The principle is applicable to various rotor-blade configurations in addition to the staggered segment configuration shown. The bed knife and cutting blade configuration may be varied for convenience in manufacturing and sharpening. The blades could be of two-piece construction rather than the unitary single piece construction shown.

We claim:

1. A granulator comprising:

a housing defining a cutting chamber;

an elongated rotor mounted for rotation about a longitudinal axis in said cutting chamber;

a reversible motor drivingly coupled to said rotor to enable rotation about said longitudinal axis in either direction;

a series of cutting knives mounted to said rotor for rotation therewith, said cutting knives defining a pair of oppositely facing cutting edges extending longitudinally on said rotor and lying on an imaginary cutting circle centered on the rotor axis, said cutting knives transversely inclined with respect to said cutting circle;

each cutting edge in said pair of cutting edges facing in an opposite direction from the other cutting edge in said pair of cutting edges, but lying on said common cutting circle centered on said rotor axis, one of said cutting edges in each pair leading upon rotation of said rotor in one direction and the other cutting edge in each pair leading upon rotation of said rotor in the opposite direction;

a fixed bed knife first peak cutting edge projecting towards said one of said cutting edges in each pair as said one blade cutting edge is rotated past said first cutting edge by rotation of said rotor in said first direction;

a fixed bed knife second peak cutting edge projecting towards said other cutting edge when said other cutting edge is rotated past said second bed knife peak cutting edge by rotation of said rotor in said opposite direction.

2. The granulator according to claim 1 wherein said fixed bed knife first and second peak edges are formed on a single bed knife member with an intervening clearance space therebetween.

3. The granulator according to claim 2 further including a second bed knife member located across said cutting circle from said first bed knife member, and also formed with first and second peak cutting edges and an intervening clearance space, said first and second peak cutting edges projecting directly at said one cutting knife cutting edge as said edge rotates up into alignment with said first cutting edge and said second peak cutting edge pointing at said other blade cutting edge as said rotor rotates said other blade cutting edge downwardly into alignment with said second peak cutting edge.

4. The granulator according to claim 2 wherein said intervening space is formed by an arcuate groove separating said first and second peak cutting edges.

5. The granulator according to claim 2 wherein said fixed bed knife member is disposed in a recess in a wall defining in part said cutting chamber, and means for fixedly holding said bed knife in adjusted positions with respect to said cutting circle.

6. The granulator according to claim 5 wherein said means include a series of adjustment screws engaging a side of said fixed bed knife member opposite a side projecting into said cutting chamber.

7. The granulator according to claim 5 further including another first and second peak cutting edge and intervening space formed on said opposite side of said bed knife member, said adjustment screws engaging a bed knife surface defining said intervening space on said opposite side thereof.

8. The granulator according to claim 5 wherein said means for holding said bed knife includes a clamping member disposed below said bed knife, and a series of bolts passing through vertical bows in said side wall and into said clamping nuts to allow clamping by said bed knife drawing said clamping nut upward to force said bed knife to engage a wall surface above said recess.

9. The granulator according to claim 2 wherein said bed knife peak cutting edges are vee shaped.

10. The granulator according to claim 1 wherein said cutting knife cutting edges are formed on opposite sides of a cutting blade.

11. The granulator according to claim 10 wherein said cutting edges on said cutting blades are vee shaped.

* * * * *